United States Patent [19]

Huang

[11] Patent Number: 4,551,997

[45] Date of Patent: Nov. 12, 1985

[54] LAMINATED PADLOCK

[76] Inventor: Chung-I Huang, No. 16, Hsing-I Rd., Tainan City, Taiwan

[21] Appl. No.: 571,593

[22] Filed: Jan. 17, 1984

[51] Int. Cl.[4] ..... E05B 67/22

[52] U.S. Cl. ..... 70/38 A; 70/52

[58] Field of Search ..... 70/38 A, 52, 39, 38 R, 70/25, 26, 386, 379 R

[56] References Cited

U.S. PATENT DOCUMENTS

| | | | |
|---|---|---|---|
| 1,938,941 | 12/1933 | Soret | 70/52 |
| 3,979,931 | 9/1976 | Man | 70/38 A |
| 4,290,280 | 9/1981 | Yum | 70/52 |

FOREIGN PATENT DOCUMENTS

| | | | |
|---|---|---|---|
| 416254 | 11/1946 | Italy | 70/52 |

*Primary Examiner*—Robert L. Wolfe

*Attorney, Agent, or Firm*—McCormick, Paulding & Huber

[57] ABSTRACT

An improved laminated padlock which includes: a lock body made of a plurality of metal plates with a central chamber and a number of openings formed therein; a cylindrical lock barrel matched with a tumbler structure disposed in the central chamber of the lock body; an improved locking mechanism movably installed in a housing structure in the upper portion of the central chamber; and a U-shaped shackle with facing notches slidingly provided in the openings of the lock body. The improved lock mechanism comprises a pair of lock members identically formed in an I-shaped structure, and a pair of elastic members also identically shaped so that a simpler structure and ab effective operation are achieved therewith.

3 Claims, 16 Drawing Figures

LAMINATED PADLOCK

BACKGROUND OF THE INVENTION

This invention relates to an improved laminated padlock and in particular relates to an improved locking mechanism fixed in the lock body which simplifies the structure of the padlock components and consequentially reduces manufacturing costs in addition to ensuring its safe locking function.

Laminated padlocks previously provided are as shown in FIGS. 1 and 2, wherein the padlock 10 includes: a lock body 11 formed of a plurality of metal plates 111 with a central chamber formed therein; a key-operated lock barrel 12 having a tumbling portion 13 and an actuating push tab 121 installed in the central chamber of the lock body 11; a movable check bolt 14 matched with a spring 141 provided in the upper portion of the central chamber operated in relation to the push tab 121 of the key-operated lock barrel 12; and a U-shaped shackle 15 with a notch 151 at the shorter end slidingly provided in the lock body 11 with a spring 152 at the longer end thereof. The known padlock 10 is shown in its locked position in FIG. 1. When the key is inserted into the key-operated lock lock barrel 12 and turned to a certain angle as shown in FIGS. 3 and 4, the push tab 121 of the operating device 12 will drive the check bolt 14 to disengage with the notch 151 of the shackle 15 which is moved to an unlocked position through the expansion of the spring 152.

The major problem of the known padlock 10 is that, since the check bolt 14 has only a unilateral check function, the padlock 10 can be easily unlocked by an unauthorized person who happens to know the structure of the padlock 10 and the side wall of the padlock 10 with a hammer or the like in the direction as shown by the arrow in FIG. 1. On being punched in that direction, the check bolt 14 will be instantaneously moved away from the point of impact, and will be disengaged with the notch 151 of the shackle 15, and the padlock 10 is rendered unlocked even without the key.

Shown in FIG. 5 is an improved laminated padlock patented in the United States under U.S. Pat. No. 3,979,931 issued to Tsui Wai Man. The improved padlock 20 as shown includes: a padlock body 21 also made of a plurality of metal plates 211 with a central chamber and some openings formed therein; a lock barrel 22 having a tumbling portion 23 at one side and a pair of cam tabs 221 at the upper end thereof installed in the central chamber; a pair of movable lock plates 24 mounted in a side-by-side relationship within the upper room of the central chamber of the lock body 21 in connection with the cam tabs 221; and a U-shaped shackle 25 having a pair of notches 251 formed in the heel and toe portions slidingly disposed in the openings of the lock body 21 with a spring 251 situated at the heel end.

The structure of the lock plates 24 is shown in FIGS. 6 and 7, wherein the lock plates 24 each include elongated shafts 241,242 which carry at opposite ends detents 2412,2422 for locking engagement with respective notches 251 when the shackle 25 is pressed inward, and at the other opposite ends extending arms 2411,2421 for being operated by the cam tabs 221 of the lock barrel 22, and a pair of springs 243 provided between the two lock plates 24 through a pair of guide pins 244 mounted between the extending arms 2411,2421 and the back side of the detents 2412,2422 in separate hollows 2413,2423 formed therein. The combined lock plates 24 are placed in the upper chamber defined by a housing B of five metal plates 111 as shown in FIG. 8, where the lower metal plate B1 is secured thereunder, defining an S-shaped opening 245 for engagement by the cam tabs 221 with respect to the extending arms 2411,2421. When the key is inserted into the lock barrel and turned to a certain angle as shown in FIG. 10, the two cam tabs 221 will respectively push the extending arms 2411,2421 backward therefrom, moving the lock plates 24 inward to retract the detents 2412,2422 from the notches 251. The spring 252 then acts to force the shackle 25 outward and unlocks the lock.

What the second known padlock shown in FIG. 5 has improved is the double lock arrangement for protecting it from being unlocked by any unauthorized person through the aforesaid hammering method. However, owing to the complicated structure of the lock plates, much room is still left to be improved.

SUMMARY OF THE INVENTION

It is accordingly a primary object of this invention to provide a laminated padlock with an improved locking mechanism for overcoming the problems associated with the prior art.

According to the present invention, this and other objects are achieved by providing an improved laminated padlock which includes: a lock body made of a plurality of metal plates with a central chamber and a number of openings formed therein; a cylindrical lock barrel having a key hole and a tumbler housing together disposed in the in the central chamber of the lock body; an improved lock mechanism movably installed in the upper portion of the central chamber in conjunction with the cylindrical lock barrel; and a U-shaped shackle with a plurality of inwardly facing notches slidingly provided in the openings of the lock body. The improved locking mechanism comprises a pair of lock members identically formed in an I-shaped plates, and a pair of disfigured elastic U-shaped springs. The lock members and the elastic springs overlap and are disposed in the upper portion of the central chamber of the lock body for being operatively engaged and disengaged with the facing notches of the shackle to effect locking and unlocking operations with the simplest, yet safest, design.

Further characteristics and advantages of this invention will become more apparent from the following detailed description of the preferred embodiment, given below with reference to the accompanying drawings.

DETAILED DESCRIPTION OF THE PREFERRED EMBODIMENT

Figure 1:
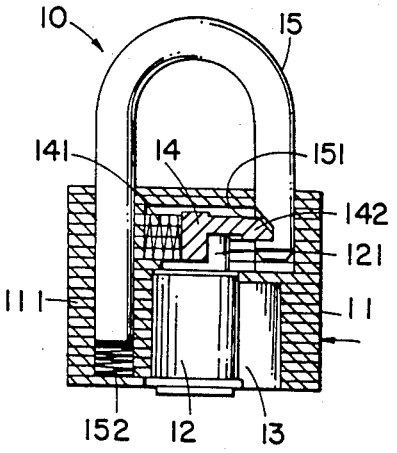
FIG. 1 PRIOR ART
FIG. 1 is a sectional view of a known laminated padlock in a locked position.
Figure 2:
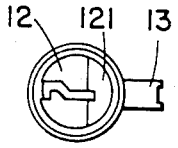
FIG. 2 PRIOR ART
FIG. 2 is a top view of the lock barrel device of the known padlock of FIG. 1 in locked condition.
Figure 3:
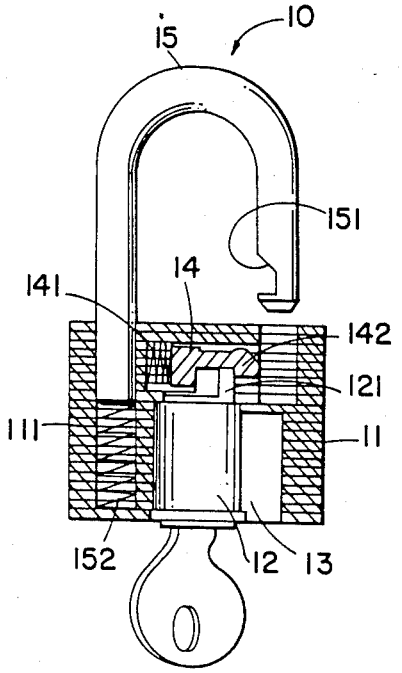
FIG. 3 PRIOR ART
FIG. 3 is a sectional view of the known padlock of FIG. 1 in an unlocked position.
Figure 4:
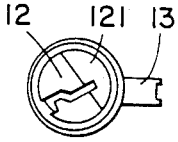
FIG. 4 PRIOR ART
FIG. 4 is a top view of the lock barrel device of the known padlock of FIG. 1 in an unlocked position.

Referring to FIG. 1, there is shown a preferred embodiment of a laminated padlock according to this invention, which padlock 30 includes in combination: a lock body 31 made of a plurality of metal plates 311 with a central chamber and a pair of facing openings formed therein; a cylindrical lock barrel 32 coupled with a tumbler portion 33 situated in the central chamber of the lock body 31; an improved lock mechanism 34 movably installed in the upper portion of the central chamber in conjunction with the lock barrel 32; and a U-shaped shackle 35 having a plurality of inwardly facing notches 351 slidingly provided in the lock body 31 with a compression spring 352 arranged at the heel end thereof. Except for the improved lock mechanism 34 and the upper portion of the central chamber related therewith, all the structure and arrangement of lock body 31, the lock barrel 32, together with the tumbler portion 33 and the shackle 35, are similar to that of the prior art shown in FIGS. 1 and 5, and the structural details and functions of those components are hereinafter omitted for clarity.

Figure 12:
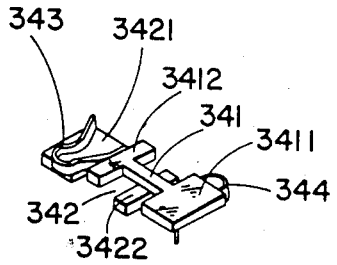
FIG. 12 is an isometric view of an improved lock mechanism of the preferred embodiment shown in FIG. 11.

Referring to FIG. 12, the improved locking mechanism 34 according to this invention comprises a pair of lock members 341 and 342, and a pair of elastic members 343 and 344. Each of the lock members 341 and 342 is identically formed in an I-shaped structure with a narrower transverse end 3412,3422 and a wider check end 3411,3421 in parallel spaced direction, and are slidingly overlapped in opposite position to one another. Each of the elastic members 343 and 344 is also identically formed in a disfigured U-shape for positioning with one of the open ends thereof abutting upon the side surface of the transverse end 3412,3422.

Figure 5:
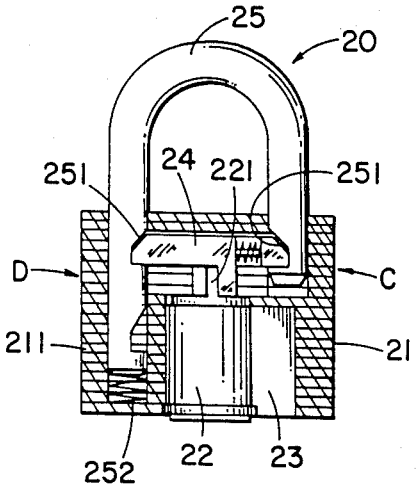
FIG. 5 PRIOR ART
FIG. 5 is a sectional view of another known laminated padlock.
Figure 6:
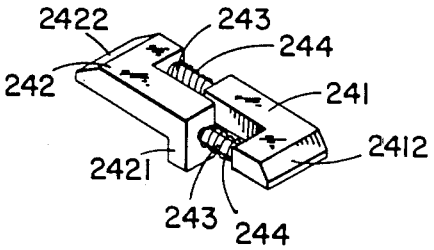
FIG. 6 PRIOR ART
FIG. 6 is an isometric view of the lock plates of the known padlock shown in FIG. 5.
Figure 7:
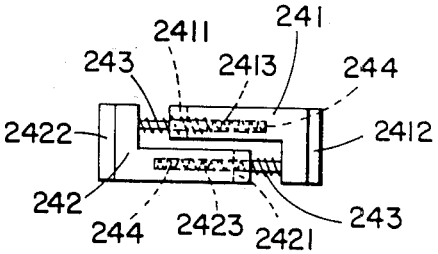
FIG. 7 PRIOR ART
FIG. 7 is a top view of the assembled lock plates shown in FIG. 6.
Figure 10:
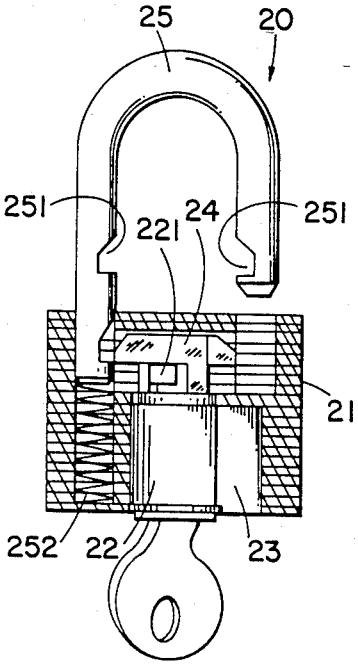
FIG. 10 PRIOR ART
FIG. 10 is a sectional view of the padlock of FIG. 5 in an unlocked position.
Figure 8:
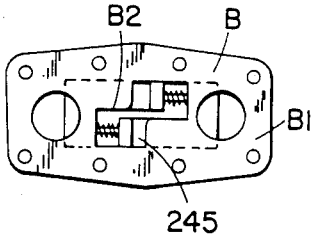
FIG. 8 PRIOR ART
FIG. 8 is a bottom view of the assembled lock plates installed in the upper chamber of the padlock of FIG. 5.
Figure 9:
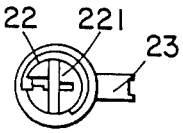
FIG. 9 PRIOR ART
FIG. 9 is a top view of the lock barrel of the padlock of FIG. 5 in an unlocked position.
Figure 13:
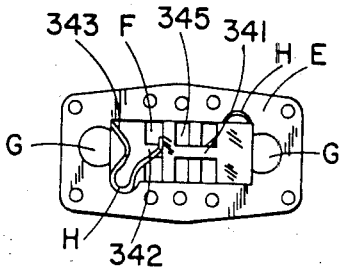
FIG. 13 is a top view of the lock mechanism assembled in the upper portion of the lock body shown in FIG. 11.

Referring to FIG. 13, the upper portion of the central chamber in the lock body 31 is defined by five pieces of the metal plates 311, wherein the top metal plate is the same as that of the prior art shown in FIG. 5, while the middle three metal plates 61 are identically formed and combined together in defining a housing body E which comprises: a rectangular space F formed in the center; a pair of shackle openings G corresponding to the openings of the top plate formed in the facing sides of the space F for slidingly receiving the heel and toe portions of the shackle 35 therein; and a pair of cavities H for spring members 343 respectively provided beside the openings G.

Figure 14:
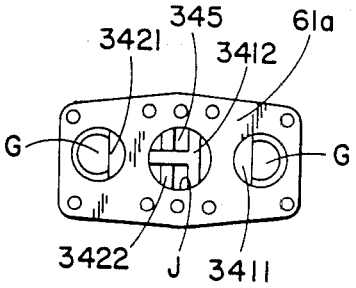
FIG. 14 is a bottom view of the lock mechanism assembled in the upper portion of the lock body shown in FIG. 11.
Figure 15:
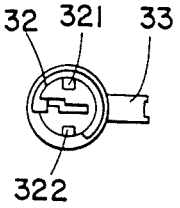
FIG. 15 is a top view of the lock barrel of the preferred embodiment in a locked position.

Referring to FIGS. 12, 13 and 14, when the locking mechanism 34 is slidingly installed in the housing body E, the closed end of each of the elastic members 343 and 344 is embedded in a relieved corner H thereof, and one end or leg of the open portion is secured in an adjacent corner of the space F while the other end or leg is abutting upon the side of the related transverse ends 3412 and 3422 of the lock members 341 and 342, and the front portion of each check end 3411,3421 patially extends in the related shackle openings G. A lower metal plate 61*a* having an opening J in the center corresponding to the front end of the lock barrel 32 and a pair of shackle openings corresponding to the openings G as shown in FIG. 14 is connected to the bottom side of the housing body E with a pair of operating spaces 345 defined by the lock members 341 and 342 located in the opening J. It shall be appreciated that both the lock members 341,342 and the elastic members 343,344 are preferably made in conjunction with the housing structure E defined by the three middle metal plates 61 and the lower metal plate 61*a* so that when the lock members 341,342 and the elastic members 343,344 are respectively installed therein, all parts of the elastic members are closely located in the cavities H as well as in the space F in connection with the lock members. As a result, when the lock members 341 and 342 are respectively slided backward in opposite directions within the space F defined by the housing structure E as shown in FIG. 13, both check ends 3411 and 3421 will simultaneously clear the facing shackle openings G so as to effect the unlocking operation.

Figure 11:
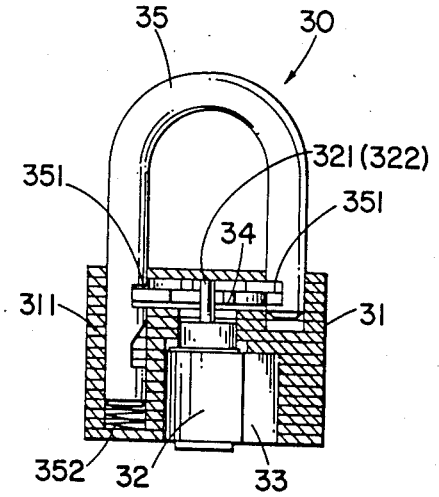
FIG. 11 is a sectional view of a preferred embodiment of an improved laminated padlock in a locked position according to this invention.
Figure 16:
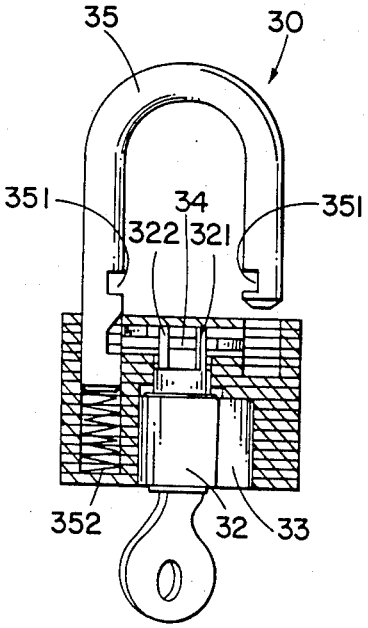
FIG. 16 is a sectional view of the preferred embodiment of FIG. 1 in an unlocked position.

Referring to FIGS. 11, 14, 15 and 16, the cylindrical lock barrel 32 comprises a pair of operating arms 321 and 322 symmetrically extending upward at the upper end thereof. When the shackle 35 and the lock barrel 32, together with tumbler portion 33, are respectively installed in the lock body 31, the two operating arms 321 and 322 are respectively received in the operating spaces 345 defined by the transverse ends 3412 and 3422 of the lock members 341 and 342 with the front end of the lock barrel 32 located in the cnetral opening J as shown in FIG. 14. By inserting the key into the lock barrel 32 and making a turn as shown in FIG. 16, the operating arms 321 and 322 will separately but simultaneously push the lock members 341 and 342 backwards in opposite directions against the open ends of the elastic members 343 and 344 so that the check ends 3411 and 3421 are separately disengaged from the notches 351 of the shackle 35, which is automatically pushed to its unlocked position by the expansion force of the spring 352. After the key is released therefrom, the lock members 341 and 342 will immediately recover their normal position through the expansion force of the elastics members 343 and 344 for effecting locking operation, which is simply done by pressing down the shackle 35 as shown in FIG. 11.

From the preceding description, it can be appreciated that the structure of the improved lock mechanism 34 according to this invention is much simpler and the assembly operation is more convenient than that of the prior art. Not only is the locking condition of the preferred embodiment effectively ensured, but also the the mass production manufacturing cost can be greatly reduced.

This invention may be embodied in other specific forms without departing from the spirit or essential characteristics thereof. The present embodiment is, therefore, to be considered in all respects as illustrative and not restricted to the scope of this invention, being limited by the appended claims.

What is claimed is:

1. An improved laminated padlock of the type having a lock body made of a plurality of metal plates with a central chamber and a plurality of openings formed therein, a cylindrical lock barrel and a tumbler portion situated in the central chamber, and a U-shaped shackle with a plurality of inwardly facing notches slidingly provided in the openings of the lock body, wherein the improvement comprises:

housing means defined by no more than three adjacent metal plates and including a rectangular space located in the center above the central chamber, a pair of shackle openings in opposing sides of said rectangular space, and a pair of cavities beside said shackle openings;

a pair of lock members each identically formed as an I-shaped structure, each member having a narrow or transverse end and a wider check end in parallel spaced position, said lock members slidingly overlapped in said rectangular space of said housing means for movement in opposite directions therein, each of said I-shaped lock members having a thickness approximately equal to that of said metal plates;

another lower metal plate having an opening in the center aligned with said central chamber and said another plate also defining a pair of openings corresponding to the shackle openings of said housing structure, said another plate defining the bottom side of the said housing structure rectangular space with respect to the front end of the lock barrel.

2. An improved laminated padlock of the type having a lock body made of a plurality of metal plates with a central chamber and a plurality of openings formed therein, a cylindrical lock barrel and a tumbler portion situated in the central chamber, and a U-shaped shackle with a plurality of inwardly facing notches slidingly provided in the openings of the lock body, wherein the improvement comprises:

housing means defined by no more than three adjacent metal plates and including a rectangular space located in the center above the central chamber, a pair of shackle openings in opposing sides of said rectangular space, and a pair of cavities beside said shackle openings;

a pair of lock members each identically formed as an I-shaped structure, each having a narrower transverse end and a wider check end in parallel spaced position, aid lock members slidingly overlapped in said rectangular space of said housing means for movement in opposite directions therein;

a pair of spring members identically formed each with a U-shape to provide a closed end and an open end and installed in said rectangular space of said housing structure with the closed end of each securely embedded in a relieved corner portion of said rectangular space and with one leg of the open end of each spring member engaging the side wall of said rectangular space, legs of the open ends of said spring members abutting said transverse ends of said lock members, another lower metal plate having an opening in the center aligned with said central chamber and said another plate also defining a pair of openings corresponding to the shackle openings of said housing structure, said another plate defining the bottom side of the said housing structure rectangular space with respect to the front end of the lock barrel.

3. In the improved padlock of claim 2 wherein said I-shaped lock members each have a thickness approximately equal to that of said metal plates.

* * * * *